United States Patent [19]

Schechter et al.

[11] Patent Number: 4,993,643

[45] Date of Patent: Feb. 19, 1991

[54] FUEL INJECTOR WITH VARIABLE FUEL SPRAY SHAPE OR PATTERN

[75] Inventors: Michael M. Schechter, Southfield; Michael B. Levin, Birmingham, both of Mich.

[73] Assignee: Ford Motor Company, Dearborn, Mich.

[21] Appl. No.: 253,462

[22] Filed: Oct. 5, 1988

[51] Int. Cl.[5] ..... B05B 1/26; F02M 61/08

[52] U.S. Cl. ..... 239/499; 239/515; 239/533.12

[58] Field of Search ..... 234/533.3, 533.7, 533.12, 234/456–458, 499, 513–515

[56] References Cited

U.S. PATENT DOCUMENTS

| | | | |
|---|---|---|---|
| 2,552,445 | 5/1951 | Nielsen | 239/456 |
| 2,559,592 | 7/1951 | Button et al. | 239/515 |
| 3,210,012 | 10/1965 | Caird | 239/499 |
| 4,046,322 | 9/1977 | Knape et al. | 239/533.7 |
| 4,273,289 | 6/1981 | Jette | 239/458 |
| 4,369,750 | 1/1983 | Muntean et al. | 239/90 |
| 4,501,245 | 2/1985 | Taira | 239/533.3 |
| 4,527,738 | 7/1985 | Martin | 234/90 |

*Primary Examiner*—Andres Kashnikow
*Assistant Examiner*—Karen B. Merritt
*Attorney, Agent, or Firm*—Jerome R. Drouillard; Clifford L. Sadler

[57] ABSTRACT

A fuel injector assembly has an outer body that is fixed to the cylinder head and an inner valve that moves to a fixed open position to discharge a fuel/compressed air or gas mixture into the combustion chamber. A control sleeve surrounds the injector body and is axially movable with respect to it to various positions to interact with the spray pattern of the fuel mixture being discharged from the nozzle to vary the shape or pattern of the fuel spray as a function of different engine operating conditions.

5 Claims, 2 Drawing Sheets

FUEL INJECTOR WITH VARIABLE FUEL SPRAY SHAPE OR PATTERN

This invention relates in general to a fuel injector construction for an automotive type internal combustion engine. More particularly, it relates to one in which fuel mixed with compressed air or other gas serving as a propellant for the fuel is injected into the combustion chamber of an engine.

In a conventional fuel injector, the initial shape of the injected fuel cloud is determined by the geometry of the valve and valve seat arrangement and remains unchanged throughout the engine operational range because the valve opening is a fixed value. It is often the case, however, that for different engine operating conditions, different shapes of fuel cloud are desirable. This invention relates to a fuel injector that permits variations in the shape of the injected fuel cloud or spray during engine operation. It provides a fuel injector with a sleeve surrounding the nozzle of the injector, the sleeve being movable with respect to the nozzle to protrude into the combustion chamber to interact with the fuel flow path to thereby effect a variable number of fuel spray paths or shapes as a function of movement of the sleeve.

The prior art recognizes the use of movable sleeves in fuel injection valves. However, these generally do not operate in the manner of the invention to interact with the fuel spray. For example, Zubaty, U.S. Pat. No. 2,820,673, shows a movable sleeve 22 that moves downwardly during the injection cycle. However, the injection valve also moves with the sleeve and it is not until the very last portion of the movement that the valve per se moves open to permit discharge of the fuel. The sleeve, therefore, plays no part in controlling the fuel spray pattern or shape.

Bletcher et al, U.S. Pat. No. 2,795,462, shows a non-analogous shower head with a movable sleeve that does not control the spray shape or pattern, but merely controls the volume of the streams of water as the sleeve moves axially.

Willmann et al, U.S. Pat. No. 4,077,374, shows a fuel injection valve assembly having an electrical potential supplied to an annular electrode 25 to generate an electrical field that ensures that a spray cone will be formed upon the displacement of the valve disc 18 relative to the opening edge 19. There is no movable sleeve that cooperates with, in effect, a stationary valve and compressed air or gas to vary the shape of the fuel spray pattern.

It is, therefore, a primary object of the invention to provide an automotive type fuel injector with a means to variably change the shape or pattern of the fuel spray being discharged from the injector to satisfy different engine operating conditions.

Figure 1:
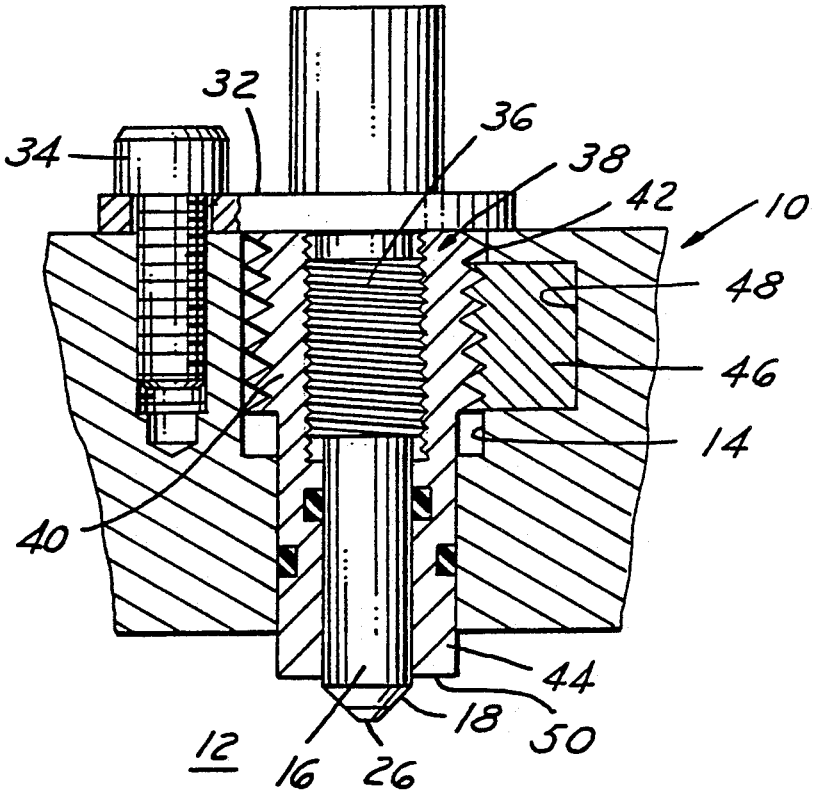
Figure 2:
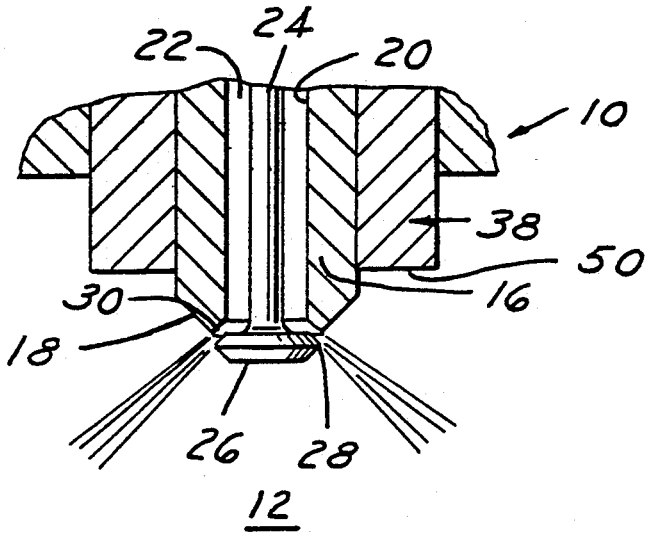
Figure 3:
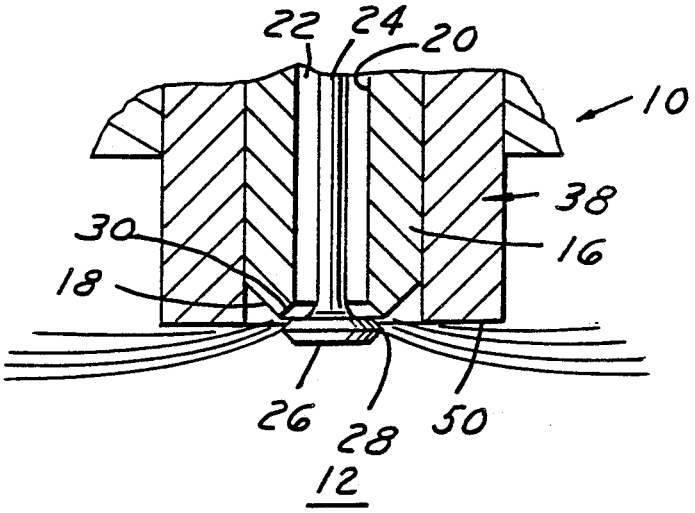
Figure 4:
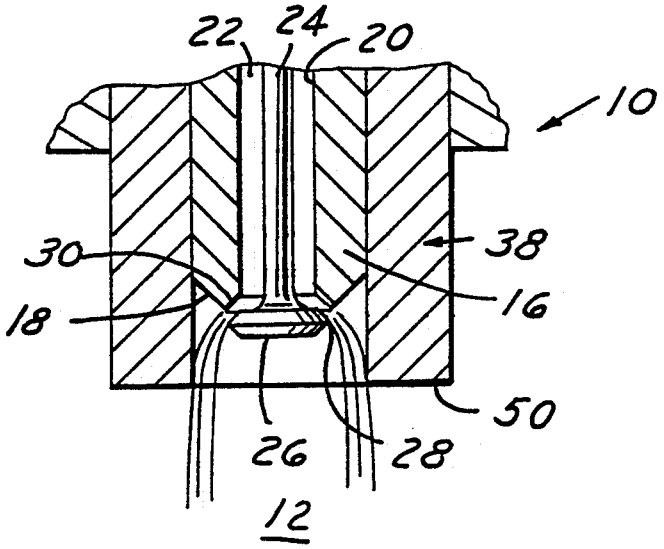

Other objects, features and advantages of the invention will become more apparent upon reference to the succeeding, detailed description thereof, and to the drawings illustrating the preferred embodiment thereof, wherein:

FIG. 1 is a cross-sectional view of a fuel injector constructed according to the invention; and FIGS. 2, 3 and 4 are views of a portion of the FIG. 1 showing, with parts broken away and in section, illustrating different operative positions of the parts shown in FIG. 1.

FIG. 1 illustrates schematically a portion 10 of the cylinder head of an automotive type internal combustion engine. It defines at its lower portion, in combination with the cylinder block, not shown, a combustion chamber indicated in general at 12. The cylinder head is provided with a recess 14 within which is placed a fuel injector body 16, which as seen in FIGS. 2, 3 and 4, is tubular in shape and open at the lower end 18. The internal diameter 20 of the tubular injector body defines an annular fuel/gas passage 22 (FIGS. 2–4) adapted to contain fuel mixed with compressed air or gas, as the case may be, to provide a more combustible, premixed charge to be injected or discharged into the combustion chamber 12. Passage 22 also contains a stem 24 of a nozzle valve, the tip 26 of which has a conventional conical-like bevelled shape that cooperates with a matingly-shaped annular chamfered valve seat 30 on the body portion 18.

The injector body, in this case, as seen best in FIG. 1, includes a flanged portion 32 apertured for insertion therethrough of a bolt 34 for rigidly securing the injector body to the cylinder head 10. The nozzle 18, in this case, has a male thread 36 on the outside of the nozzle, for cooperation with a central control sleeve 38 having a corresponding female thread, that is secured onto the nozzle. The control sleeve is of stepped diameter construction having a larger diameter upper portion 40 shaped as a gear 42, and a lower portion 44 sealingly movable within the opening in the cylinder head 10, as shown. A rack member indicated in general at 46 interacts with gear 42 and is located in another recessed portion 48 of the cylinder head for movement in a direction perpendicular to the plane of FIG. 1 to effect an axial movement of the sleeve 38 vertically, as shown in FIG. 1, upon movement of the actuator. Both the tip 18 of the nozzle and the bottom 50 of the control sleeve protrude into the combustion chamber 12. Moving the rack 46, therefore, changes the protrusion of the sleeve 38 into combustion chamber 12 and thus varies the shape of the fuel spray.

Referring now to FIGS. 2, 3 and 4, it will be seen from FIG. 2 that control sleeve 38 has been moved to a position where it protrudes less than the tip 18 of the nozzle. Therefore, as the valve or pintle 26 of the injector moves to the fixed, open or unseated position shown, allowing discharge of the fuel/gas mixture through the annular opening between the valve seat and valve, the fuel spray will be determined by the geometry of the valve and valve seat and, therefore, is of a conical pattern, as indicated.

FIG. 3 illustrates the control sleeve 38 moved to a position where it protrudes into combustion chamber 12 about the same as the nozzle; i,e., essentially aligned with the nozzle tip or valve 26. In this position, the interaction between the compressed air or gas flow in passage 22 from the injector, and the surface of the bottom of the sleeve 50, causes the fuel spray to change its initial direction from that shown in FIG. 2 to flow essentially parallel to the bottom 50 of the sleeve and thereby form a disc-shaped-like spray or pattern that has a tendency to remain in the top portion of the combustion chamber 12, as shown.

When the sleeve 50 is moved further down into the combustion chamber to protrude more than the nozzle, as shown in the position in FIG. 4, the fuel spray now is deflected by the sleeve and changes into one that highly penetrates into the combustion chamber, and one of almost cylindrical shape directed almost vertically downwardly into the combustion chamber.

From the foregoing, therefore, it will be seen that the fuel injector assembly shown and described provides an infinite number of different positions of the control sleeve to thereby provide an infinitely different number of spray shapes or patterns for the fuel/compressed air or gas being discharged from the injector. This, therefore, provides a vast number of different patterns varying as a function of engine operating conditions to provide a more efficient fuel injection assembly and system.

While the invention has been shown and described in its preferred embodiment, it will be clear to those skilled in the arts to which it pertains that many changes and modifications may be made thereto without departing from the scope of the invention.

I claim:

1. An engine type fuel injector with variable fuel spray pattern comprising in combination, an injector having an outer stationary tubular-like body containing fuel and chamfered at one end and slidably receiving therein a nozzle type valve having a conical-like tip seated against and closing the one end of the body, the tip being movable to an unseated position to open the one end of the body for the flow of fuel outwardly therebetween, the shape of the tip and chamfered end deflecting the fuel essentially diagonally outwardly therefrom in a spray pattern, and a spray pattern control sleeve axially movably mounted on the body and movable with respect thereto and to the tip to variable positions into the path of the fuel spray for interacting with and deflecting the path of the fuel spray and thereby changing the shape of the spray, with said injector further comprising rack and pinion means for moving said sleeve.

2. An injector as in claim 1 wherein said rack and pinion means moves the control sleeve between a first position locating the lower end of the sleeve vertically above the tip and out of the path of the fuel spray being discharged, to a second position aligning the end of the sleeve with the tip and therefrom to a plurality of positions locating the lower end of the sleeve vertically past and beyond the tip.

3. An injector as in claim 2, the second position of the sleeve directing the fuel to flow approximately parallel to the lower end of the sleeve forming a disc-like spray pattern, the plurality of positions of the sleeve directing the fuel to form an essentially cylindrical shape providing a highly penetrating vertical column of fuel directed downwardly from the top.

4. An injector as in claim 1, the control sleeve having an external gear thereon for engagement with a rack on an actuator for axially moving the sleeve.

5. A fuel injector for use with an automotive type internal combustion engine having a cylinder head and a combustion chamber defined therein into which fuel is to be injected, comprising a tubular-like injector body for containing fuel open at its lower end, the body receiving axially slidably therein a valve closing the lower end movable downwardly away from the body to permit flow of fuel from the body, the lower end of the body and the valve defining a flow path therebetween for the flow of fuel outwardly from the body in a generally diagonal-like direction, and a fuel spray pattern control sleeve surrounding the injector body and being axially movable with respect thereto, and means to move the control sleeve axially to positions interacting with the flow path of the fuel to thereby change the direction of the fuel spray as a function of the axial movement of the sleeve, said injector further comprising means for securing the body to the cylinder head and for preventing movement of the body, the head having a recess therein for receiving the body in a nested manner, with the control sleeve having a portion thereof received in the recess for limiting the axial motion of the sleeve, with said injector further including gear means on the sleeve and head and actuator means for engaging the gear means to axially move the sleeve relative to the body and valve.

* * * * *